US005351627A

United States Patent [19]

Junaedi

[11] Patent Number: 5,351,627

[45] Date of Patent: Oct. 4, 1994

[54] PORTABLE PALLET ASSEMBLY

[75] Inventor: Satria Junaedi, Arcadia, Calif.

[73] Assignee: Satria International, Temple City, Calif.

[21] Appl. No.: 994,100

[22] Filed: Dec. 21, 1992

[51] Int. Cl.[5] ..... B65D 19/12

[52] U.S. Cl. ..... 108/56.1; 108/901

[58] Field of Search ..... 108/51.1, 901, 902, 108/56.1, 56.3, 55.1

[56] References Cited

U.S. PATENT DOCUMENTS

| | | | |
|---|---|---|---|
| 3,835,792 | 9/1974 | Wharton | 108/56.1 |
| 3,949,929 | 4/1976 | Kupersmit | 108/56.1 X |
| 4,694,962 | 9/1987 | Taub | 108/56.1 X |
| 4,735,154 | 4/1988 | Hemery | 108/56.1 |
| 4,843,976 | 7/1989 | Pogott et al. | 108/56.3 X |
| 4,895,000 | 1/1990 | Thomas | 108/56.1 |
| 5,176,465 | 1/1993 | Holsted | 108/56.3 X |
| 5,197,396 | 3/1993 | Breezer et al. | 108/56.3 |

FOREIGN PATENT DOCUMENTS 2617983 11/1976 Fed. Rep. of Germany ..... 108/56.3

*Primary Examiner*—Jose V. Chen

*Attorney, Agent, or Firm*—James E. Brunton

[57] ABSTRACT

A portable pallet assembly which is made up of two or more lightweight, moldable plastic modules of high structural integrity which are interconnected by novel interconnection mechanisms. The modules can be connected in a side-by-side relationship to form a rigid pallet assemblage having a substantial surface area. Alternatively, first and second modules can be connected in a side-by-side configuration to form a first assemblage to which a second assemblage made up of third and fourth interconnected modules can be connected to form a rigid, double layer pallet construction. Additionally, individual booster units can be connected to raise the assemblages sufficiently to permit the forks of a forklift truck to be received beneath the article supporting surface of the assemblage.

10 Claims, 7 Drawing Sheets

13
14
-16-
12
20
22
24
26
30
32
36
40
46
74
81
85
92
94
96

PORTABLE PALLET ASSEMBLY

BACKGROUND OF THE INVENTION

Field of the Invention

The present invention relates generally to material handling apparatus. More particularly, the invention concerns a portable pallet assembly for use in handling, storing and moving articles and materials from place to place.

DISCUSSION OF THE INVENTION

A wide variety of pallet constructions have been suggested for use in storing and transporting materials. Some prior art pallets are transported by hand and others by the use of forklift trucks or other mechanical means. Typically, prior art pallets are constructed from wood and include lengths of planking to which skids are affixed to raise the surface of the pallet a sufficient distance to permit the forks of a forklift truck to slip beneath the planking. As a general rule these wooden pallets are heavy and quite cumbersome to move by hand. Additionally, they are easily damaged in use and have a very short useful life.

There has long been a need for a light-weight, virtually indestructible pallet that can be used in lieu of the traditional wooden pallets. While attempts have been made to construct such pallets from moldable plastic materials, such pallets have typically tended to be too small and too fragile for heavy-duty industrial use.

The pallet assembly of the present invention overcomes the drawbacks of prior art plastic pallets by providing for the first time light weight, but very strong modular platform units which can be readily interconnected together to form large single or double layer pallets having substantial surface area.

The modular platform units of the invention are uniquely molded to provide light weight, strong and very durable units that include novel connector mechanisms which permit several units or modules to be interconnected in various configurations. More particularly, the modules of the invention can be connected in a side-to-side arrangement to provide a large, light weight, single layer pallet having substantial surface area. Booster units can be removably connected to the underside of the interconnected modules to raise the assembly sufficiently to permit the insertion of forks of forklift trucks. Alternatively, two assembles, each made up of interconnected side-by-side modules, can be connected in a back-to-back relationship to provide a double layer, extremely rigid, four-module pallet construction. When the pallet assemblages are not in use they can be easily disassembled for storage.

The modules of the invention are constructed from a durable, scratch and decay resistant plastic material that is lightweight, waterproof and odorless. Tie-down tabs are provided along the sides of the pallet assemblies to permit them to be conveniently raised and lowered using ropes and cables. Friction imparting buttons are affixed to the top surface at spaced-apart locations to resist sliding of articles placed on the pallet assemblage.

Each of the molded modules is uniquely constructed having strategically located hollow portions and spaced-apart apertures which reduce the overall weight of the module without effecting its structural integrity.

SUMMARY OF THE INVENTION

It is an object of the present invention to provide a portable pallet assembly which is made up of two or more lightweight modules of high structural integrity which are interconnected by novel interconnection mechanisms.

Another object of the invention is to provide a pallet assembly of the aforementioned character in which the modules can be connected in a side-by-side relationship to form a rigid pallet assemblage having a substantial surface area.

Another object of the invention is to provide a pallet assemblage of the character described in the preceding paragraph to which individual booster units can be connected to raise the assemblage sufficiently to permit the forks of a forklift truck to be received beneath the article supporting surface of the assemblage.

Another object of the invention is to provide an apparatus of the general character described, in which first and second modules can be connected in a side-by-side configuration to form a first assemblage to which a second assemblage made up of third and fourth interconnected modules can be connected to form a rigid, double layer pallet construction.

Still another object of the invention is to provide a light weight, portable pallet assemblage which is provided with a plurality of weight reducing apertures that are strategically located to substantially reduce the weight of the assemblage without adversely affecting the structural integrity thereof.

Another object of the invention is to provide an apparatus of the class described in which each of the modules is constructed from a lightweight plastic material that is scratch resistant, waterproof and odorless and one which can be used in adverse environments without damage and decay.

Yet another object of the invention is to provide a pallet assemblage of the character described which includes strategically located tie-down tabs and non-skid buttons adapted to frictionally engage articles and materials placed on the pallet assembly.

Still another object of the invention is to provide a pallet assembly that can be readily moved by hand or by forklift truck and one that can be inexpensively produced in quantity.

DESCRIPTION OF THE INVENTION

Figure 1:
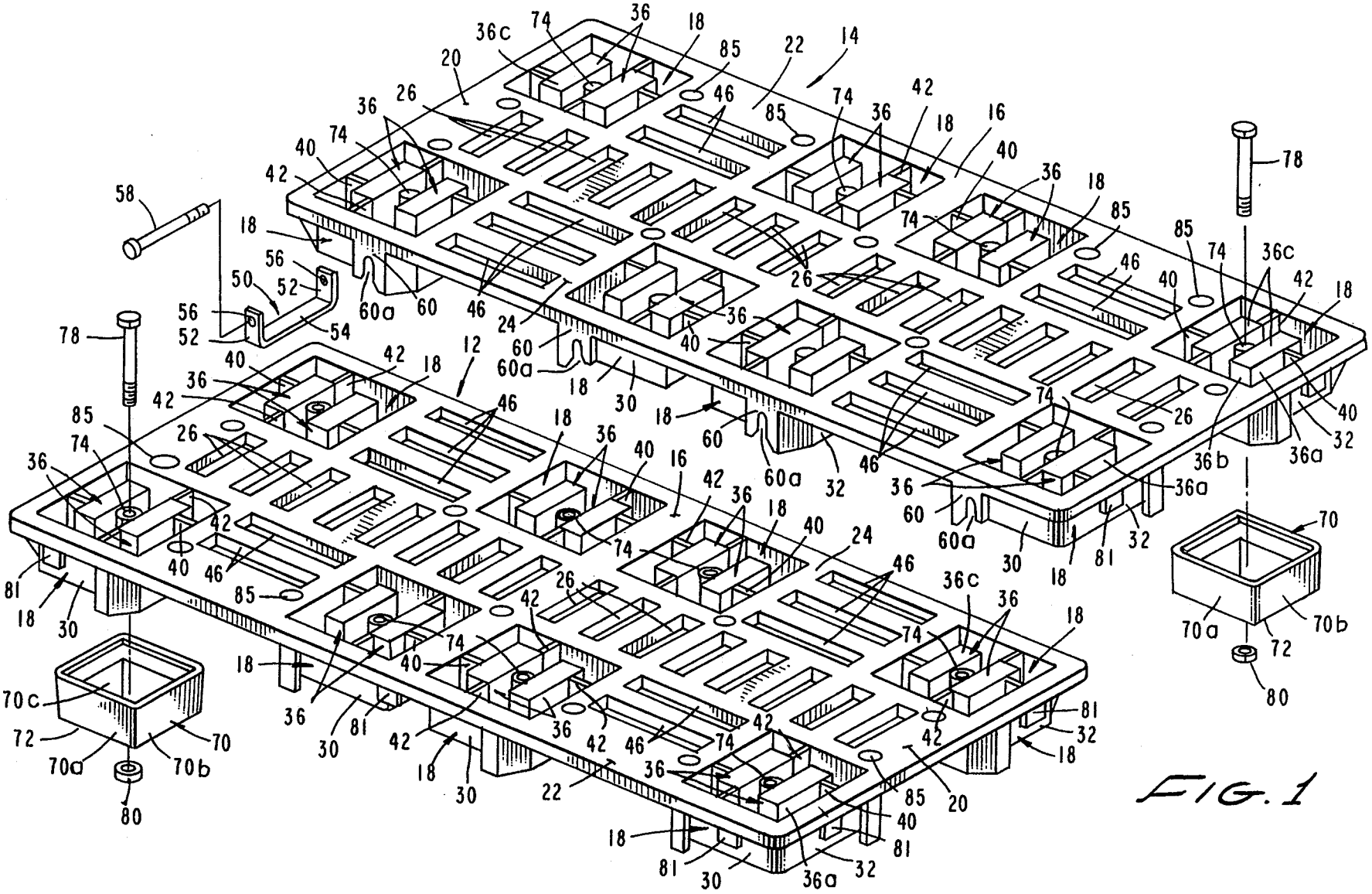
FIG. 1 is a generally perspective exploded view of one form of the pallet construction of the present invention.
Figure 2:
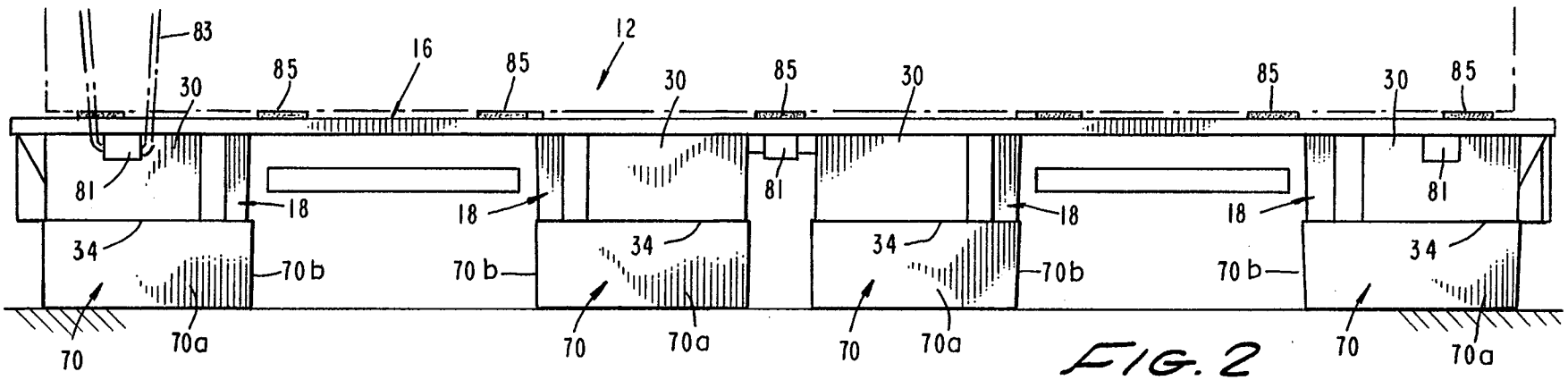
FIG. 2 is a side view of the pallet construction.
Figure 3:
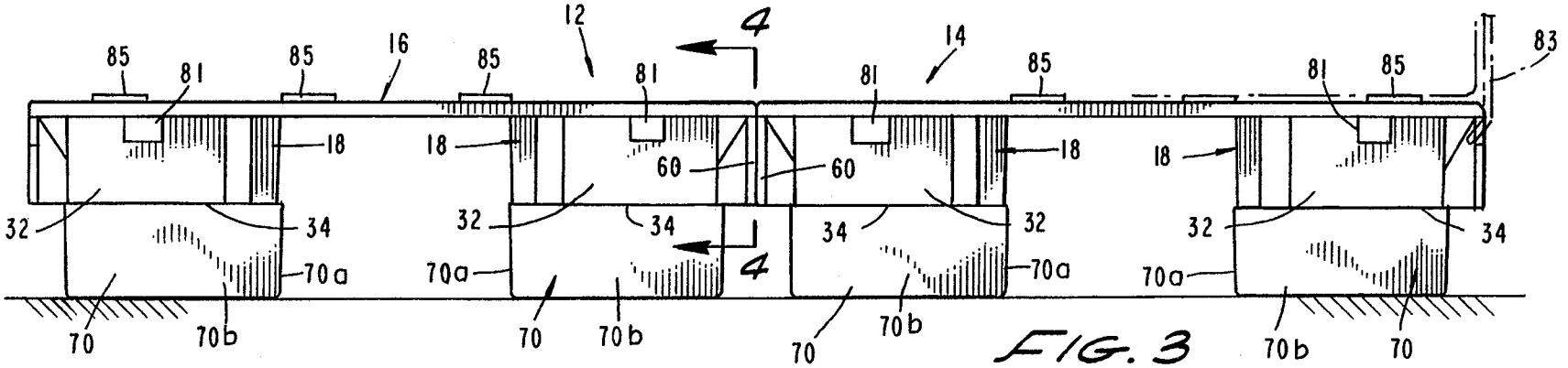
FIG. 3 is an end view of the pallet construction.

Referring to the drawings and particularly to FIGS. 1, 2, and 3 one form of the portable pallet assemblage of the present invention is there illustrated. In this embodiment of the invention, the assembly comprises first and second moldable plastic platform units or modules 12 and 14 each having a top support wall 16 and a plurality of spaced-apart, hollow support pedestals 18 depending from the top support wall.

The top support wall of each platform unit includes a central section 20 and transversely spaced side sections 22 and 24. (See also FIG. 5). The center area or section 20 of each of the units is provided with a plurality of longitudinally spaced, weight reducing apertures 26. Apertures 26 effectively reduce the weight of the pallet assemblage without, in any way, adversely affecting its structural integrity.

Figure 4:
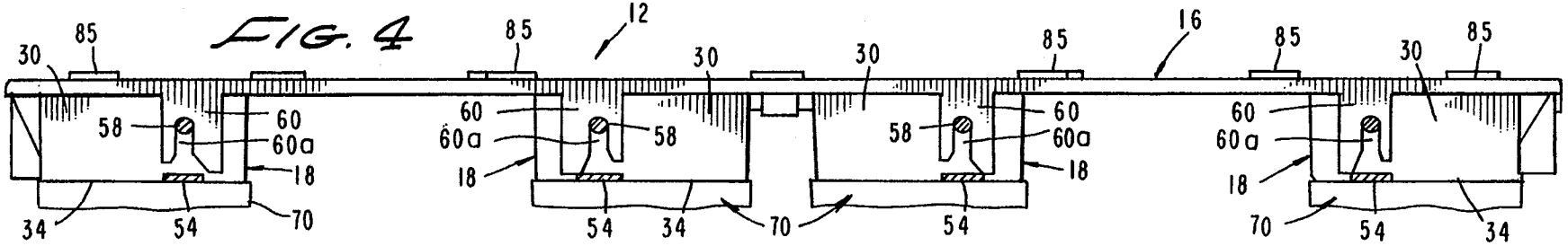
FIG. 4 is a view taken along lines 4—4 of FIG. 3.

The hollow support pedestals 18 of each module depend from each of the side areas of the top wall and each includes side, end and bottom walls 30, 32, and 34 respectively (FIGS. 2, 3 and 4). These side and bottom walls define basin-like recesses of the character best seen in FIG. 1. Provided within each recess is a pair of upwardly extending, island-like, hollow protuberances 36. As will presently become more clear, these island-like protuberances function to provide structural integrity to the platform unit and also function as points of interconnection for the connector means which of the invention interconnect the first and second units together in a side-by-side relationship.

As indicated in the upper right-hand portion of FIG. 1, each of the upstanding, island-like protuberances comprises interconnected side and top walls 36*a*, 36*b*, and 36*c* respectively. The side and end walls are preferably integrally formed with the bottom wall 34 of the basin-like recesses and the top wall 36*c* is preferably disposed in the plane of the upper surface of top support wall 16. With this construction, the top walls 36*c* of the hollow island-like protuberances provide article support surfaces while the hollow spaces interiorly of the protuberances contribute to the weight reduction aspect of the apparatus without adversely affecting the structural integrity thereof. In similar fashion, the open portions within the basin-like recesses which surround the island-like protuberances markedly contribute to weight reduction. To further improve the structural integrity of the unit, web-like reinforcing members 40 interconnect the side walls of the island-like protuberances with the end walls of the pedestals while reinforcing members 42 connect the end walls of the island-like protuberances with the side walls of the pedestals. (See FIG. 5)

Figure 5:
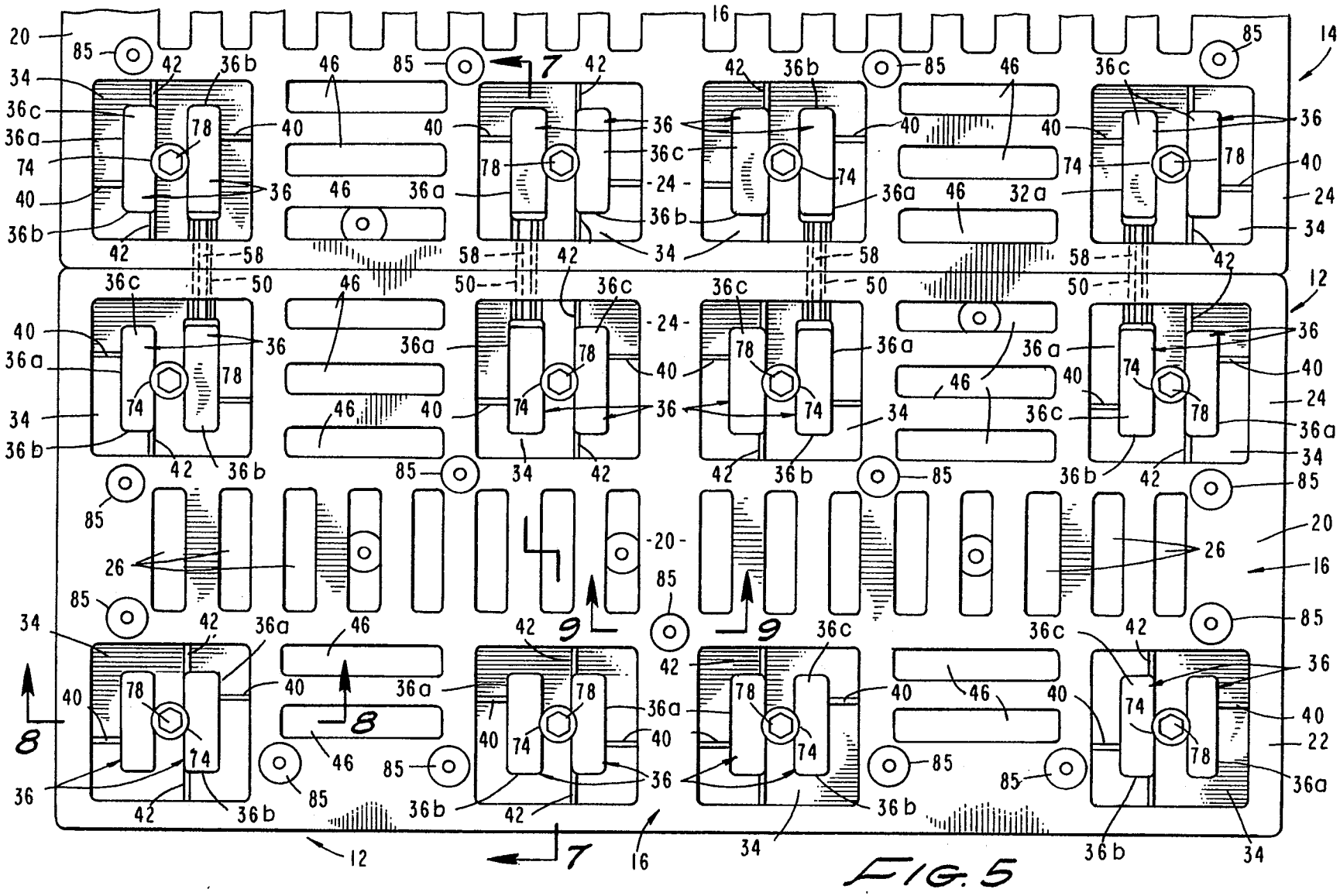
FIG. 5 is a fragmentary top view of the pallet construction.

As also clearly seen in FIGS. 1 and 5, the hollow support pedestals 18 are located at each corner of each module of the assemblage and a pair of spaced-apart support pedestals are provided centrally of each of the side sections of the modules. Provided in the areas of the top wall located intermediate the end or corner pedestals and the centrally located pedestals are further weight reducing apertures 46. As best seen in FIG. 5, apertures 46 extend generally perpendicular to apertures 26 which are provided in the central sections of the modules.

An important feature of the embodiment of the invention shown in FIG. 1 comprises first connector means for interconnecting the first and second platform units 12 and 14. As best seen by referring to FIG. 1 and 7, the first connector means of this form of the invention comprises a generally U-shaped rigid connector member 50, preferably made of metal, having end walls 52 and a bight portion 54. End walls 52 are provided with apertures 56 that are adapted to receive therethrough an elongated connector bolt 58. As also seen in FIGS. 1 and 7, slotted, downwardly-depending connector tabs or engagement walls 60 are provided on each of the platform units and are adapted to be abutted together in the manner illustrated in FIG. 7 when the platform units are interconnected.

Figure 6:
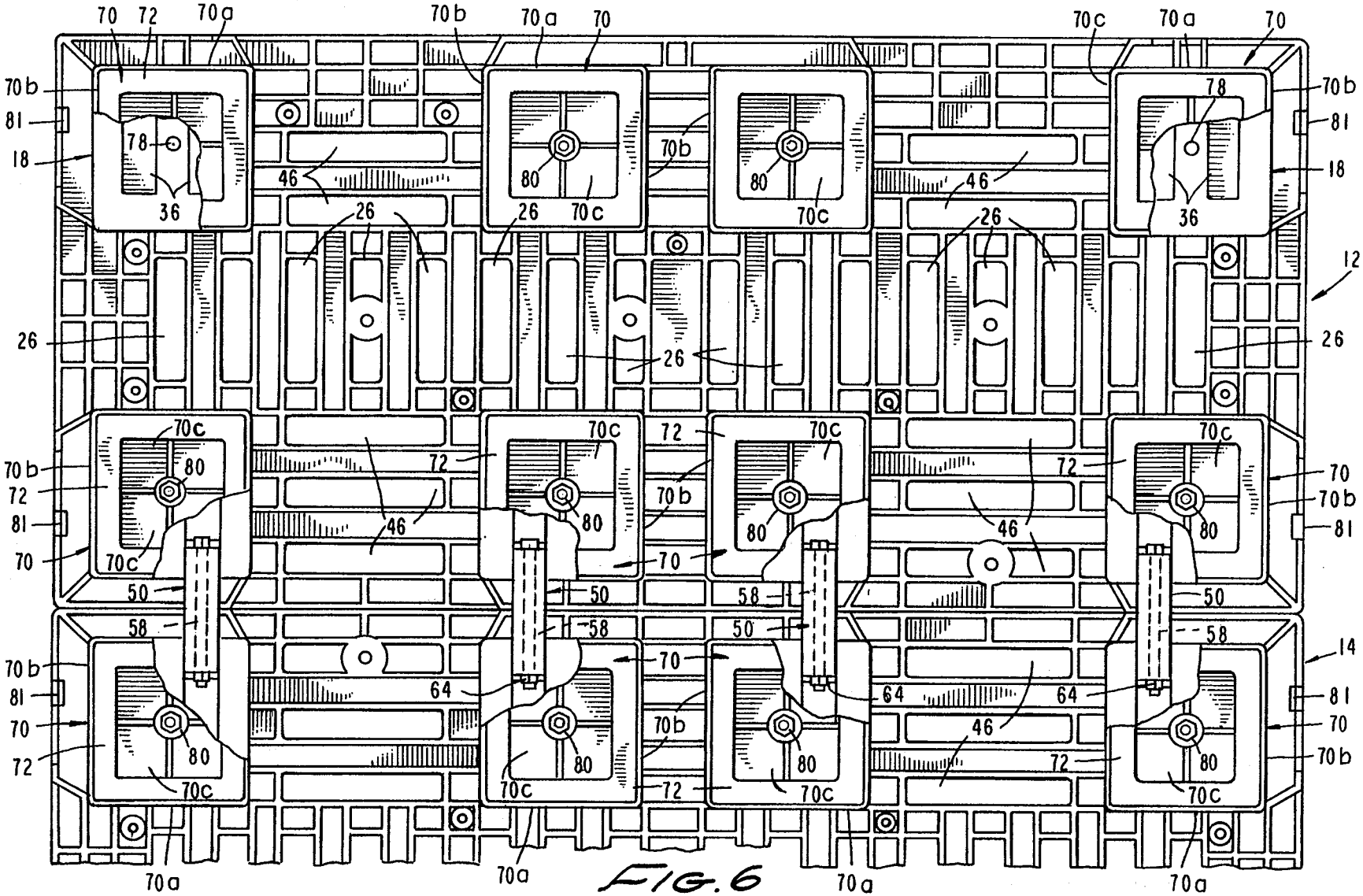
FIG. 6 is a fragmentary bottom view of the pallet construction partly broken away to show internal construction.
Figure 7:
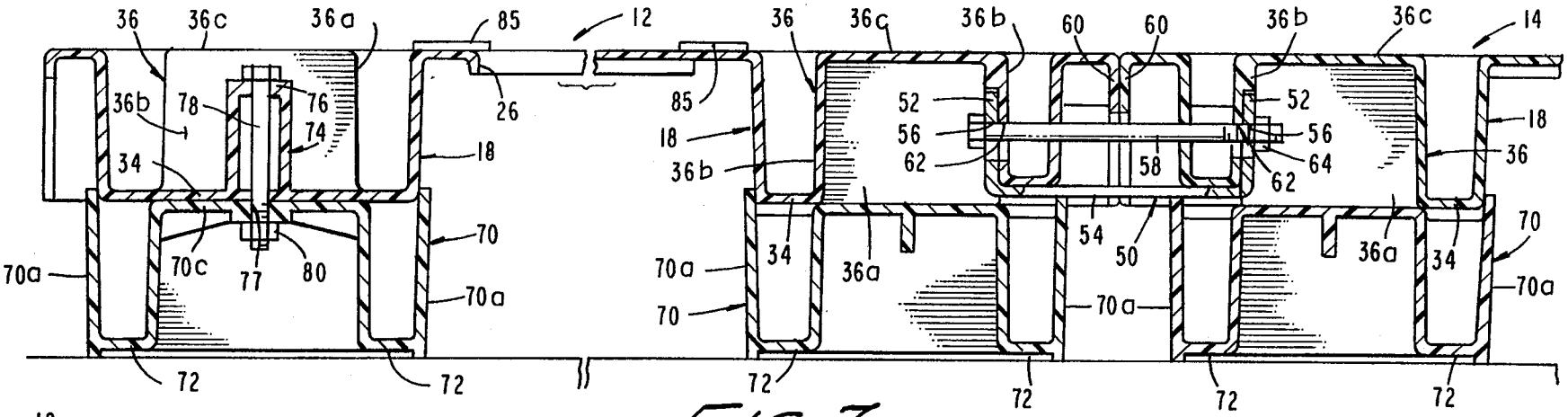
FIG. 7 is a cross-sectional view taken along lines 7—7 of FIG. 5.
Figure 14:
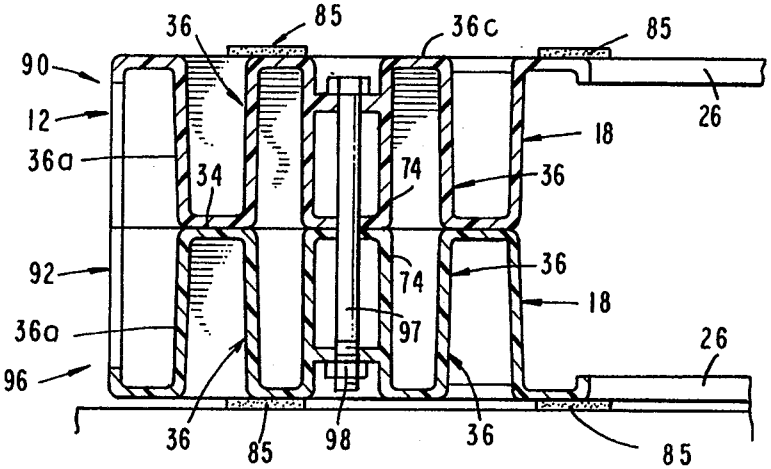
FIG. 14 is a cross-sectional view taken along lines 14—14 of FIG. 10.

As indicated in FIGS. 6 and 7, the U-shaped connector brackets 50 are received within selected islands-like protuberances 36, one of the end walls of which is provided with an aperture 62 that is adapted to receive therethrough bolt 58. With this construction, the platform units can be interconnected by abutting connector tabs 60 together, placing the end walls 52 of the connector members in the interior of the adjacent protuberances 36 and inserting bolt 58 through one end portion 52 of the U-shaped connector. The bolt is then urged through the aligned aperture 62 provided in the end wall 36*b* of the island-like protuberance 36, through the slot 60*a* (see FIG. 4) provided in the abutting connector tabs, and finally through the aperture 62 provided in the end wall 36*b* of the adjacent island-like protuberance provided on the second platform unit. A nut 64 is then threaded over bolt 58 and snugged down so as to securely clamp the connector tabs 60 and the side edges of the modules together. As is apparent from a study of FIGS. 5 and 6, four connector units are used to interconnect the first and second platform units 12 and 14 in the abutting relationship shown in FIG. 7. When the platform units are thusly connected, a pallet assemblage having an upper surface of substantial area is provided for use in the storage or transport of articles and materials.

Another important feature of the portable pallet assemblage shown in FIG. 1 involves the provision of a plurality of booster assemblies 70 which can be removably connected to selected hollow support pedestals 18 of the first and second platform units. As best seen by referring to FIG. 7, each of the booster assemblies 70 comprises interconnected side, end and top walls 70*a*, 70*b* and 70*c* respectively. Inner walls 70*b* cooperate with outer walls 70*a* to form hollow, ground engaging supporting feet 72.

Also comprising a part of each booster assembly is second connector means for connecting the booster assembly to a selected one of the hollow support pedestals 18 of the modules 12 and 14. The second connector assembly here comprises a plurality of hollow, upstanding, boss-like protuberances 74 which are disposed within each of the basin-like recesses 18 intermediate the pairs island-like protuberances 36. Each of the boss-like protuberances 74 has an apertured top wall 76 which is adapted to receive an elongated connector bolt 78 which also forms a part of the second connector means of the invention. Top wall 70*c* of each of the booster units has a centrally disposed portion of increased wall thickness which is also apertured to receive bolt 78 in the manner best seen in the left-hand portion of FIG. 7. When the booster assemblies are interconnected with the platform units, the top wall of each booster assembly is abutted against the bottom wall of each of the pedestals 18 of the platform units. The bolt 78 is inserted through the hollow boss-like connector 74 and then through the aperture 77 provided in the top wall of the booster assembly. A nut 80 is then threaded on to bolt 78 and secured down so as to securely clamp the top wall 70*c* of the booster assembly against the bottom wall 34 of the pedestal 18.

With the booster assemblage securely affixed to each of the pedestals of each of the first and second platform units, the platform units are elevated a sufficient distance to permit the forks of a forklift truck to be inserted beneath the upper wall of the platform units so that the pallet assemblage can be conveniently moved from place to place. The booster assemblies also function to elevate the upper surface of the pallet to raise the articles and materials stored thereon sufficiently above ground level to prevent them from being damaged from surface water and the like.

Figure 9:
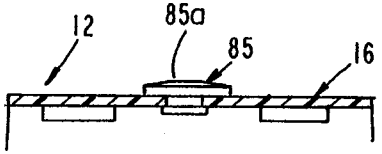
FIG. 9 is a cross-sectional view taken along lines 9—9 of FIG. 5.
Figure 8:
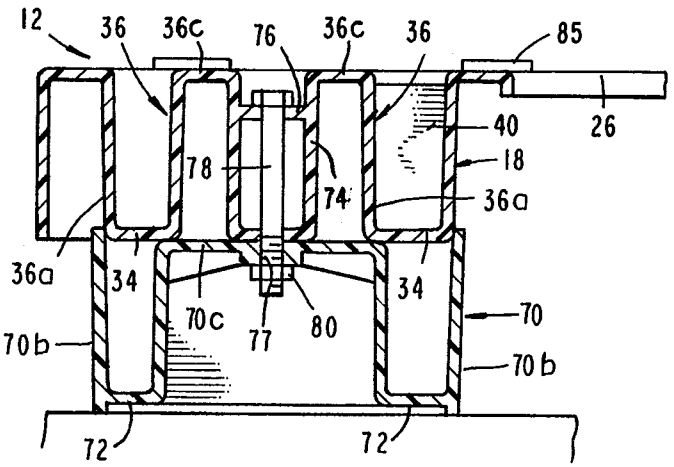
FIG. 8 is a cross-sectional view taken along lines 8—8 of FIG. 5.
Figure 10:
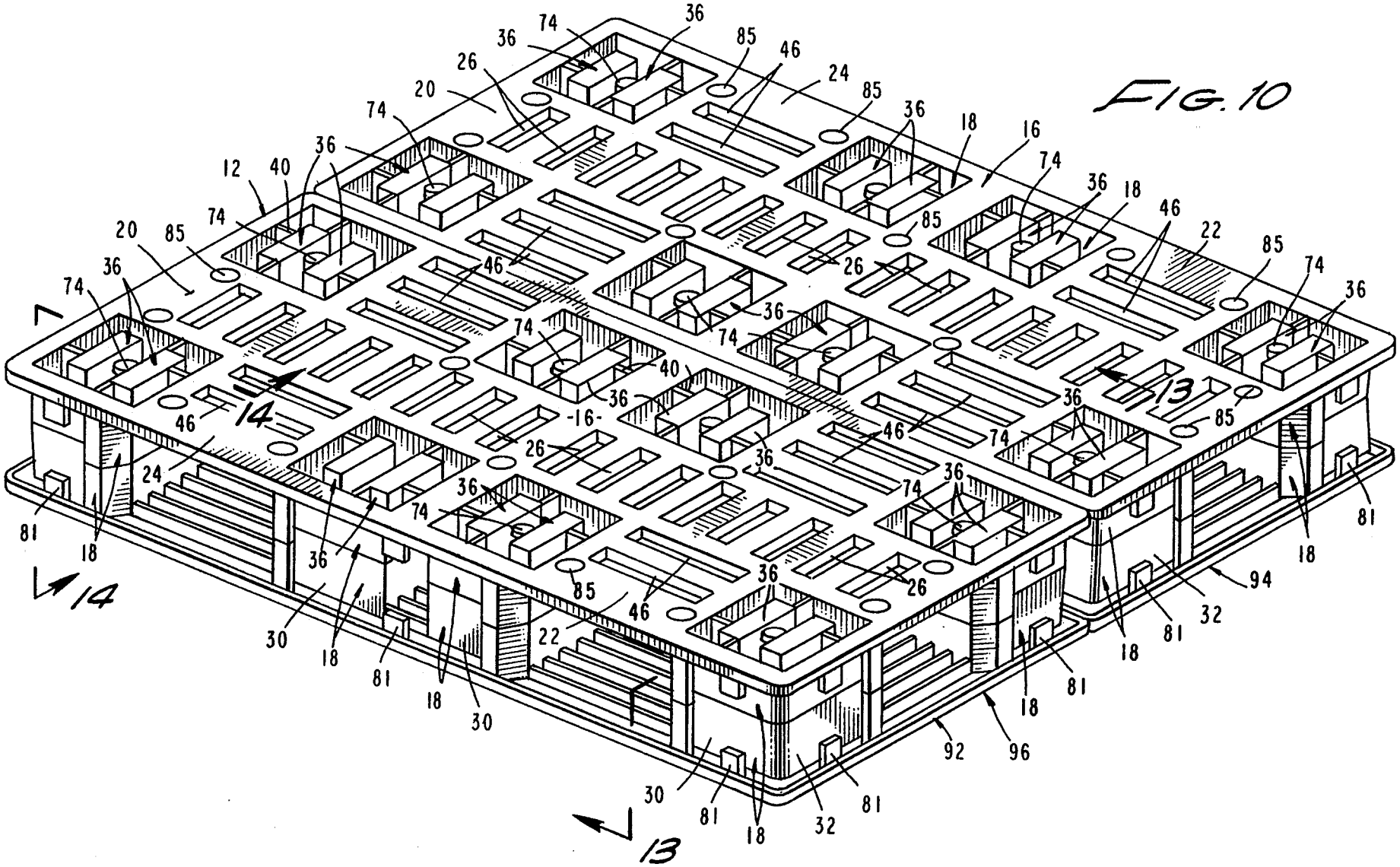
FIG. 10 is a generally perspective view of an alternate form of pallet construction.
Figure 11:
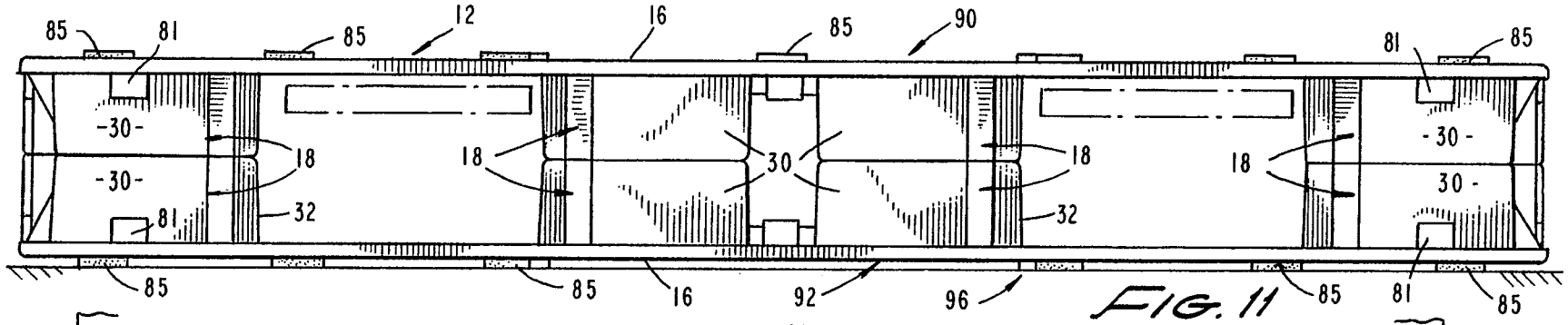
FIG. 11 is a side view of the pallet construction of FIG. 10.
Figure 12:
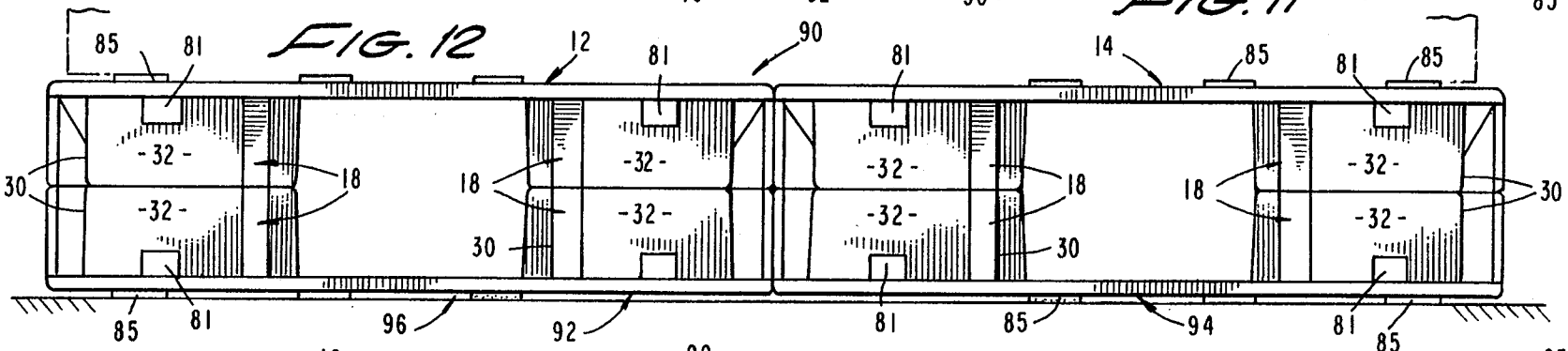
FIG. 12 is an end view of the pallet construction of FIG. 10.

As indicated in FIG. 2, tie-down tabs 81 are longitudinally spaced along each side of the first and second platform units to permit the pallets to be raised with ropes 83 in the manner indicated in FIGS. 1 and 2. Additionally, as best seen in FIG. 9, a plurality of friction means are provided at various locations on the top support wall of the first and second platform units. The friction means is here provided in the form of a plurality of buttons 85 which are affixed to the top support wall of each of the platform units at spaced-apart locations. The upper surface 85*a* of each of the friction is constructed of an elastomeric material which imparts frictional resistance to any sliding movement of articles or materials emplaced on the upper surface of the pallets.

Turning now to FIGS. 10 through 13, another form of pallet assembly of the present invention is there illustrated. In this form of the invention, first and second platform units 12 and 14 have been interconnected in the manner previously described to form an upper pallet assemblage generally designated in FIG. 10 by the numeral 90. In a similar manner, third and fourth platform units 92 and 94 of a construction identical to that previously described have been interconnected. These second and third platform units have also been interconnected in the manner described to form a lower pallet assemblage 96 which is interconnected with pallet assemblage 90 in a back-to-back relationship to form a double layer pallet assemblage of the character shown in FIG. 10. Each of the first, second, third and fourth platform units is of identical construction to that previously described and like numerals are used to identify like components in FIGS. 10 through 13.

Figure 13:
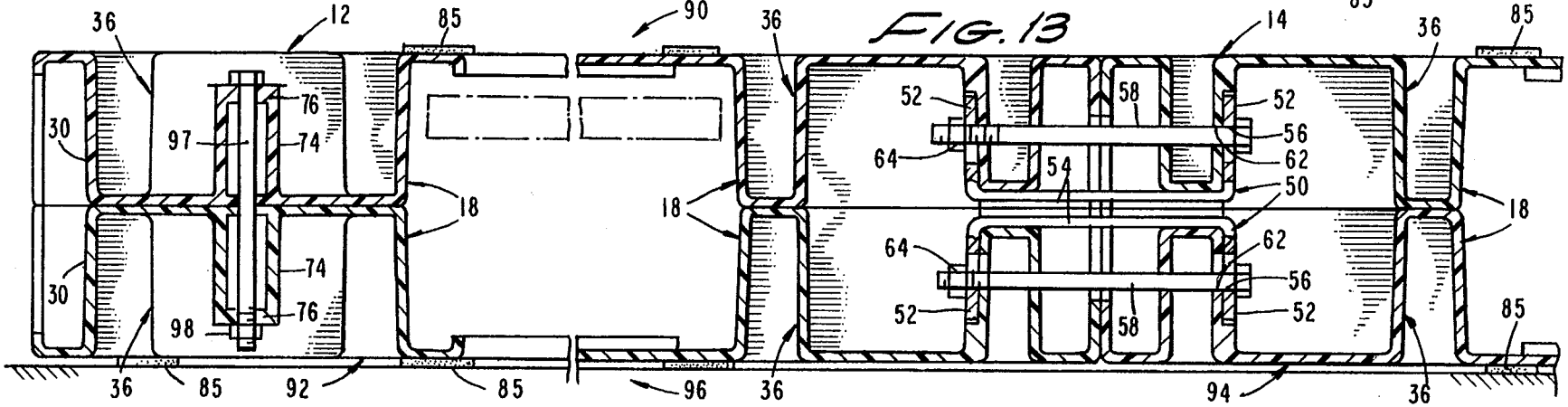
FIG. 13 is a cross-sectional view taken along lines 13—13 of FIG. 10.

Referring particularly to FIG. 13, it is to be noted that the first and second, and third and fourth pallet units have been interconnected using connector means comprising U-shaped connectors 50 and interconnecting bolts 58. Similarly, the boss-like protuberances 74 are used in interconnecting assemblages 90 and 96 by means of a third connector means which here comprises elongated bolts 97. As best seen in FIG. 13, when assemblages 90 and 96 are butted against one another in a back-to-back relationship, boss-like protuberances 74 align so that bolts 97 can be inserted through the apertures provided in the top walls of the protuberances and will extend through the interior of the abutting protuberances 74. With the bolts extended through the abutting protuberances 76 in the manner shown in FIG. 13, nuts 98 are threaded onto the bolts and tightened down to securely abut together assemblages 90 and 96 to form the back-to-back, extremely rigid pallet double layer construction shown in FIG. 10.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A portable pallet assembly for use in handling, storing and moving articles and materials comprising:

(a) first and second platform units, each said unit comprising:

(i) a top support wall having a central area and transversely spaced side areas;

(ii) a plurality of hollow support pedestals depending from each of said side areas, each said hollow pedestal comprising interconnected side, end and bottom walls defining a basin like recess, each said recess having at least one upwardly extending island like protuberance provided therewithin, each said island like protuberance comprising interconnected side and end walls connected to said bottom walls of said hollow support pedestals, one of said end walls of said protuberance having an aperture;

(b) first connector means for interconnecting said first and second platform units, said first connector means comprising:

(i) a generally U-shaped rigid connector member having end walls interconnected by a bight portion, each said end wall of said U-shaped rigid connector member having an aperture; and (ii) an elongated bolt removably received through said apertures of said end walls of said connector member and through said apertures of said end walls of said protuberances.

2. An assembly as defined in claim 1, further including a plurality of booster assemblies removably connected to selected hollow support pedestals of said first and second platform units, each said booster assembly comprising:

(a) interconnected side, end and top walls; and (b) second connector means for connecting said booster assemblies to said second hollow support pedestals.

3. An assembly as defined in claim 1 further including third and fourth platform units and third connector means for connecting said first and second platform units to said third and fourth platform units.

4. A portable pallet assembly for use in handling, storing and moving articles and materials comprising:

(a) first and second platform units each said unit comprising:

(i) a top support wall having a central area and transversely spaced side areas;

(ii) a plurality of hollow support pedestals depending from each of said side areas, each said hollow pedestal comprising interconnected side, end and bottom walls defining a basin like recess, each said recess having disposed therewithin a pair of spaced-apart, upwardly-extending, island-like protuberances, each having interconnected side and end walls connected to said bottom walls of said hollow support pedestals, one of said end walls of said protuberance having an aperture; and (b) first connector means for interconnecting said first and second platform units, said first connector means comprising:

(i) a generally U-shaped rigid connector member having end walls interconnected by a bight portion, each said connector member end wall having an aperture; and (ii) an elongated bolt removably received through said apertures of said end walls of said connector member and through said apertures in said end walls of said protuberances.

5. A pallet assembly as defined in claim 4 in which each said side areas of said top support wall is provided with a pair of centrally disposed support pedestals and a pair of end support pedestals.

6. An assembly as defined in claim 5 further including a booster assembly removably connected to each of said centrally disposed support pedestals and to each of said end pedestals of said first and second platform units, each said booster assembly comprising:

(a) interconnected side, end and top walls, said top wall having a central aperture; and (b) second connector means for connecting said booster assembly to said end support pedestal.

7. An assembly as defined in claim 6 in which said second connector means comprises:

(a) a hollow, boss-like protuberance disposed within each of said basin-like recesses intermediate said island-like protuberances; and (b) an elongated bolt receivable through said apertures in said top walls of said booster assemblies and through said hollow, boss-like protuberances.

8. An assembly as defined in claim 7 further including frictional means provided on said top support wall for frictional engagement with articles emplaced on said platform units.

9. An assembly as defined in claim 8 in which said friction means comprises a plurality of elastomeric buttons affixed to said top support wall.

10. A portable pallet assembly for use in handling, storing and moving articles and materials comprising:

(a) first, second, third, fourth platform units each said unit comprising:

(i) a top support wall having a central area and transversely spaced side areas, said central area being provided with a plurality of spaced-apart apertures;

(ii) a plurality of hollow support pedestals depending from each of said side areas, each said hollow pedestal comprising interconnected side, end and bottom walls defining a basin like recess, each said recess having disposed therewithin a pair of spaced-apart, upwardly-extending, island-like protuberances, each having interconnected side and end walls connected to said bottom walls of said hollow support pedestals, one of said end walls of said protuberance having an aperture;

(b) first and second platform connector means for interconnecting said first and second platform units, to form a first assemblage, each said first and second platform connector means comprising:

(i) a generally U-shaped rigid connector member having end walls interconnected by a bight portion, each said connector member end wall having an aperture; and (ii) an elongated bolt removably received through said apertures of said end walls of said connector member and through said apertures in said end walls of said protuberances;

(c) third and fourth platform connector means for interconnecting said third and fourth platform units to form a second assemblage, each said third and fourth platform connector means comprising:

(i) a generally U-shaped rigid connector member having end walls interconnected by a bight portion, each said connector member end wall having an aperture; and (ii) an elongated bolt removably received through said apertures of said end walls of said connector member and through said apertures in said end walls of said protuberances; and (d) assemblage connector means for interconnecting said first and second assemblages.

* * * * *